US006206226B1

(12) United States Patent
Coates

(10) Patent No.: US 6,206,226 B1
(45) **Date of Patent: *Mar. 27, 2001**

(54) LINING SYSTEM

(76) Inventor: Steven J. Coates, 188 Rhodes Circle, Newmarket, Ontario (CA), L3X 1V3

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/114,894

(22) Filed: Jul. 14, 1998

(51) Int. Cl.[7] ..... B65D 88/06
(52) U.S. Cl. ..... 220/565; 220/567.1; 220/567.2
(58) Field of Search ..... 220/565, 560.03, 220/567.1, 567.2, 23.9, 62.18, 62.19, 62.22

(56) References Cited

U.S. PATENT DOCUMENTS 1,259,320 * 3/1918 Tyler ..... 220/23.9
2,028,957 * 1/1936 Carlstrom ..... 220/23.9
2,028,968 * 1/1936 Carlstrom ..... 220/23.9
4,640,439 * 2/1987 Palazzo ..... 220/445
4,916,939 * 4/1990 Mogel ..... 73/49.2
5,018,324 * 5/1991 Lankheet ..... 52/169.7
5,261,764 * 11/1993 Walles ..... 405/52
5,860,762 * 1/1999 Nelson ..... 404/6

* cited by examiner

*Primary Examiner*—Stephen Castellano

(57) ABSTRACT

A field applied lining system for the inside surface of fluid containment vessels is described. The lining system includes a lining joined to the inner walls of a fluid containment vessel, defining an interstitial space between the inner wall of the storage tank and the lining. The lining consisting of a plurality of panels of pre-manufactured Fiber Reinforced Plastic joined to each other. A support structure is placed in the interstitial space, the support structure defining avenues for fluid flow through the interstitial space. One or more conduits are provided between the interstitial space and one or more sampling ports placed at the perimeter of the one or more sampling ports placed at the perimeter of the storage tank, permitting access to the interstitial space and the avenues for fluid flow through the interstitial space.

11 Claims, 2 Drawing Sheets

LINING SYSTEM

The present invention relates to a field applied lining system for the inside surface of fluid containment vessels. The lining provides corrosion protection, leak detection and secondary containment of leaks.

Various types of corrosion protection, leak detection and secondary containment systems are known. The conventional method is double walled tanks, with the outer wall normally comprised of steel or concrete, with the inner wall providing the primary structural basis and fluid containment for the tank. The inner wall can be anything from a plastic or fibre lining, to a second steel wall welded to the first. The interstitial space defined by the inner and outer wall of the tank provides a secondary containment chamber for fluid in the event a leak should occur through the inner wall, for example as a result of corrosion, a faulty weld or resin bond, or mechanical stress.

The interstitial space is conventionally filled with sand or other granular supporting material, but in some prior art may contain a support structure for the inner wall which permits fluid flow, such as a wire mesh or aluminum foil sheeting. This allows for avenues of fluid flow in the interstitial space and simplifies the detection of leaks. One or more fluid sensing monitors are located in the interstitial space. These must normally be located near the bottom of the tank to facilitate detection.

There are several major problems with the prior art. While double wall tanks provide satisfactory secondary containment, they are expensive and time consuming to fabricate, since they require the construction of two complete tanks of different sizes, the smaller tank being assembled inside the larger one. In addition, if there is a leak into a sand bed or other granular supporting material in the interstitial space, this material must be removed, disposed of and replaced. All three of these requirements generate further expenditure of both money and time.

Another problem is that fluid leaks are often not detected until they are quite far advanced, as the sensor locations are relatively remote from where leaks generally occur. The prior art which attempts to solve this problem, in one instance, uses a wire mesh to provide avenues of fluid communication and allow for faster leak detection. The problem with this usage is that the wire mesh is subject to corrosion and may have to be replaced, and also requires a plurality of sampling ports as fluid communication is not complete through the wire mesh. Some of the prior art uses a vacuum in the interstitial space and monitors pressure changes to detect leaks. But this system is inaccurate because changes in pressure can result from temperature changes, and fluid bleeding through walls where there is no leak.

The most important problem with the prior art is that no lining system exists which can be applied to existing tanks in the field, and so deterioration during use cannot be remedied except at great expense or by replacing the entire tank.

It is desirable to have a lining system for fluid containment vessels which is relatively inexpensive and may be installed in the field, and which provides for the rapid detection of leaks. The lining system must be corrosion resistant, structurally strong enough to provide primary containment of the fluid in question, and yet flexible enough that it does not buckle when the fluid containment vessel is subject to mechanical stress. The outer wall should be able to expand, flex or even crack and not affect the inner wall.

It is also desirable to have a lining system which does not require extensive and expensive replacement of components in the case of a leak, but which is simple and inexpensive to repair in the field if a problem develops.

It is also desirable to have a leak detection system that provides rapid and uniform leak detection for the entire vessel.

The present invention relates to a field applied lining system for the inner surface of fluid containment vessels. The primary containment membrane is constructed from manufactured Fibre Reinforced Plastic panels. These panels are joined by pop rivets which are flush on the liquid side of the membrane and extend into the interstitial space on the back side of the panels. A sealing laminate is then applied over the edges of the panels where they touch each other and at the edge of the lined area where the panels need to be joined to the inner surface of the vessel. A further advantage of these panels is that if a leak occurs in a panel or between panels, a very small area of the lining needs to be repaired or replaced. The panels need not be adhered to the outer wall, except at the edges of the liner. This means that the inner surface of the outer wall does not have to be specially prepared, although the section of the surface area to which the panels will be attached may be prepared by sandblasting and priming with a high adhesion primer. Furthermore, the outer wall can flex, expand or crack and not affect the liner. More importantly, the panels will usually fit through the existing access holes in the vessel, and accordingly, no mechanical modifications to this vessel are required. As long as the edges are properly sealed, the lining system will not be affected by most of the traditional failure mechanisms in fluid containment vessels.

The support structure in the interstitial space consists of an open grid of High Density Polyethylene, which provides shock absorption against impact damage to the panels. This grid also provides for avenues of fluid communication through the interstitial space. A vacuum can be drawn on the interstitial space at any time to confirm the integrity of both the inner and outer walls of the containment vessel. The interstitial space is quite small, and this aids in the rapid detection of leaks as very little fluid is required to fill this space. This factor has the additional advantage of requiring far fewer leak detection ports. The interstitial space may be vented, which results in a pressure differential which allows any fluid in this space to travel quickly and prevents the interstitial space from having a higher pressure and thus interfering with leak detection.

The advantage to this lining system is that it can be applied to horizontal and vertical surfaces. Further, the panels are translucent, which allows for easy tracing of leaked liquid in order to rapidly find leaks. There is no contaminated material in the case of a leak.

Another advantage of this system is that both the panels and the grid can be cut out using non-sparking or cold work methods. This is especially important where the fluid being contained is flammable or through the interstitial space very easily. Many such systems are currently available in the marketplace.

The invention, as exemplified by a preferred embodiment, is described with reference to the drawings in which.

Figure 1:
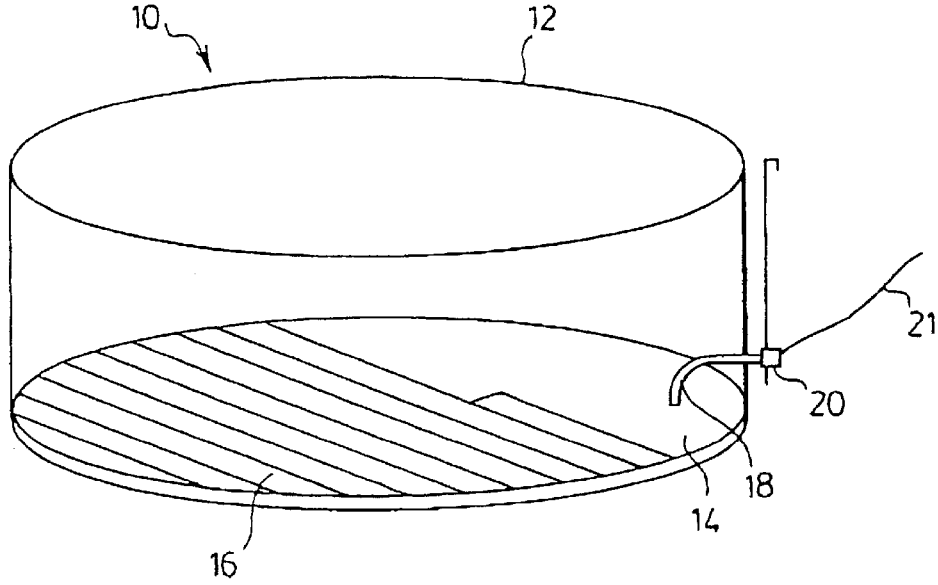
FIG. 1 is a perspective view of an embodiment of the invention.

Referring to the drawings, specifically FIG. 1, the embodiment of the invention shown, a lining system 10 comprises a fluid containment vessel 12 composed of a rigid material. A support structure 14, preferably composed of a High Density Polyethylene grid, is placed on the inner surface of the vessel to be lined, creating an interstitial space between the inner surface of the vessel and the lining system, which consists of panels 16, preferably composed of Fibre Reinforced Plastic, which are applied to the inside surface of the vessel. In this embodiment of the invention, there is one conduit 18 between the interstitial space and a corresponding sampling port 20. There may also be a conduit 21 to a remote leak monitor. Other embodiments of the invention can divide the interstitial space into several different leak detection zones, with several different conduits going to several different sampling ports. Because of the sensitivity to leak detection of this lining system, this is often not necessary.

Figure 2:
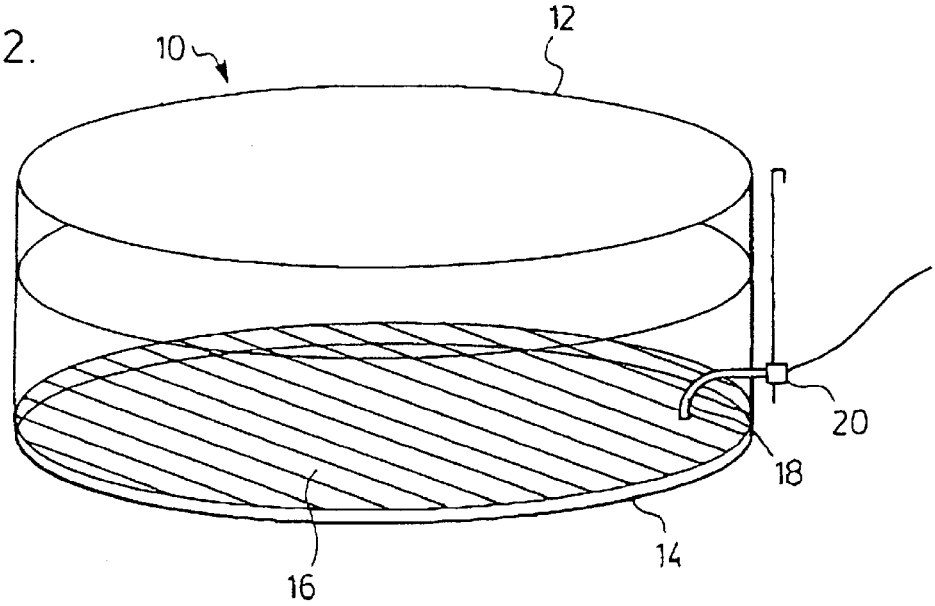
FIG. 2 is a view of the embodiment shown in FIG. 1, with the vessel full of liquid.

FIG. 2 illustrates how the fluid containment vessel appears when it contains liquid.

Figure 3:
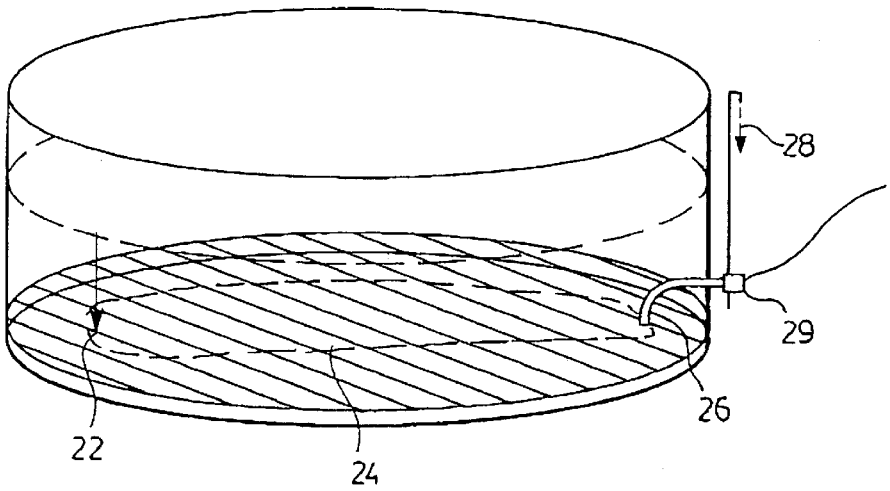
FIG. 3 is a view of the embodiment shown in FIG. 2, with a leak having occurred.

FIG. 3 illustrates what occurs in one embodiment of the invention when a leak occurs at point 22. The leak causes fluid to spread quite rapidly into zone 24. This leakage quickly reaches the point of attachment 26 of the conduit to the lining. The fluid then travels up the conduit to the sampling port, where opening of the valve at 29 will reveal the leak as a result of fluid flowing out at 28.

Figure 4:
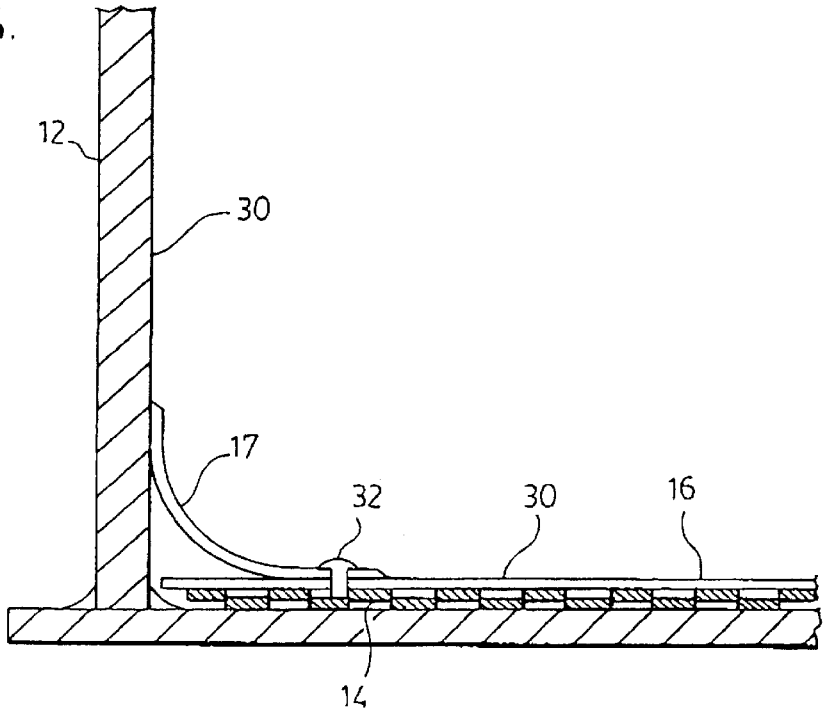
FIG. 4 is a side view of the lining system applied to a corner of a fluid containment vessel.

In FIG. 4, the lining is attached to the corner of the vessel by one of the flexible panels 17 being bent into shape to cover this area. This creates a smooth transition between the floor and sides of the vessel. Portions of the surfaces 30 of both the panels and the vessel may be prepared for adhesion of the laminate, the vessel by sandblasting and priming with a high adhesion primer. The two panels are joined together by a pop rivet 32, with the head portion of the pop rivet being flush with the inner surface of the lining, while the body of the rivet extends into the interstitial space. Contrary to the means of application of the laminate to the floor panels, which is done only at the seams, the sealing laminate is applied over the entire corner panel to ensure a secure and airtight bond.

The embodiments of the invention in which are exclusive property or privilege is claimed are defined as follows:

1. A field lining system for the inside surface of fluid containment vessels comprising a lining joined to the inner walls of a fluid containment vessel, defining an interstitial space between said inner wall of said storage tank and said lining;

the lining consisting of a plurality of panels of pre-manufactured Fiber Reinforced Plastic joined to each other, wherein said panels are translucent;

a support structure placed in said interstitial space, said support structure defining avenues for fluid flow through said interstitial space; and one or more conduits between said interstitial space and one or more sampling ports placed at the perimeter of the storage tank, permitting access to said interstitial space and to said avenues for fluid flow through said interstitial space.

2. A field lining system for the inside surface of fluid containment vessels comprising a lining joined to the inner walls of a fluid containment vessel, defining an interstitial space between said inner wall of said storage tank and said lining;

a support structure placed in said interstitial space, said support structure defining avenues for fluid flow through said interstitial space; and one or more conduits between said interstitial space and one or more sampling ports placed at the perimeter of the storage tank, permitting access to said interstitial space and to said avenues for fluid flow through said interstitial space; wherein said support structure consists of an open grid of High Density Polyethylene.

3. A field applied lining system for the inside surface of fluid containment vessels as claimed in claim 2, wherein each said conduit is joined to said lining by a means of attachment at a breach in said lining, each said conduit corresponding to and joined to each sampling port at a point on said inner surface of said fluid containment vessel not covered by said lining.

4. A field applied lining system for the inside surface of fluid containment vessels as claimed in claim 3, wherein each said breach in said lining consists of a stainless steel adaptor plate comprising a pipe fitting for attachment to said conduits, and said means of attachment consists of placing said adaptor plate on a layer of laminate and then laminating the whole to said lining.

5. A field lining system for the inside surface of fluid containment vessels comprising a lining joined to the inner walls of a fluid containment vessel, defining an interstitial space between said inner wall of said storage tank and said lining;

the lining consisting of a plurality of panels of pre-manufactured Fiber Reinforced Plastic joined to each other;

a support; structure placed in said interstitial space, said support structure defining avenues for fluid flow through said interstitial space; and one or more conduits between said interstitial space and one or more sampling ports placed at the perimeter of the storage tank, permitting access to said interstitial space and to said avenues for fluid flow through said interstitial space; wherein said lining panels are joined to each other by pop rivets, the head portion of said pop rivets being flush in the inner surface of said lining while the body portion of said pop rivets extends into said support structure, the edges of said lining panels then being covered with a field applied laminate.

6. A field applied lining system for the inside surface of fluid containment vessels, comprising:

a lining joined to the inner walls of a fluid containment vessel, defining an interstitial space between said inner wall of said fluid containment vessel and said lining, said lining composed of a plurality of panels of manufactured Fiber Reinforced Plastic joined together by pop rivets, the head portion of said pop rivets being flush on the inner surface of said lining while the body portion of said pop rivets extends into said support structure, the edges of said lining panels then being covered with a field applied laminate;

a support structure placed in said interstitial space, said support structure defining avenues for fluid flow through said interstitial space, said support structure consisting of an open grid of High Density Polyethylene; and one or more conduits between said interstitial space and one or more sampling ports placed at the perimeter of the fluid containment vessel, permitting access to said interstitial space and to said avenues for fluid flow through said interstitial space.

7. A field applied lining system for the inside surface of fluid containment vessels as claimed in claim 6, wherein each said conduit is joined to said lining by a means of attachment at a breach in said lining, each said conduit corresponding to and joined to each said sampling port at a point on said inner surface of said fluid containment vessel not covered by said lining.

8. A field applied lining system for the inside surface of fluid containment vessels as claimed in claim 7, wherein said breach in said lining consists of a stainless steel adaptor plate comprising a pipe fitting for attachment to said conduits, and said means of attachment consists of placing said adaptor plate on a layer of laminate and then laminating the whole to said lining.

9. A field applied lining system for the inside surface of fluid containment vessels, comprising:

a lining joined to the inner walls of a fluid containment vessel, defining an interstitial space between said inner wall of said fluid containment vessel and said lining, said lining composed of a plurality of panels of manufactured Fiber Reinforced Plastic joined together by pop rivets, the head portion of said pop rivets being flush on the inner surface of said lining while the body portion of said pop rivets extends into said support structure, the edges of said lining panels then being covered with a field applied laminate;

a support structure placed in said interstitial space, said support structure defining avenues for fluid flow through said interstitial space, said support structure consisting of an open grid of High Density Polyethylene; and one or more conduits between said interstitial space and one or more sampling ports placed at the perimeter of the fluid containment vessel, permitting access to said interstitial space and to said avenues for fluid flow through said interstitial space, each said conduit joined to said lining by a means of attachment at a breach in said lining, each said conduit corresponding to and joined to each said sampling port at a point on said inner surface of said fluid containment vessel not covered by said lining, each said breach in said lining consisting of a stainless steel adaptor plate comprising a pipe fitting for attachment to said conduits, and said means of attachment consisting of placing said adaptor plate on a layer of laminate and then laminating the whole to said lining.

10. A field applied lining system for the inside surface of fluid containment vessels as claimed in claim 9, wherein each said sampling port is connected to a leak detection system for detecting the presence of fluid in said interstitial space.

11. A field applied lining system for the inside surface of fluid containment vessels as claimed in claim 10, wherein said leak detection system consist of a valve which may be opened to allow any fluid in said interstitial space to flow out.

* * * * *